US005468172A

United States Patent [19]

Basile

[11] Patent Number: 5,468,172

[45] Date of Patent: Nov. 21, 1995

[54] DOLL INCLUDING RECORDED MESSAGE MEANS

[76] Inventor: Pauline R. Basile, 418 S. Valley Forge Rd., Devon, Pa. 19333

[21] Appl. No.: 245,523

[22] Filed: May 18, 1994

Related U.S. Application Data

[63] Continuation of Ser. No. 957,242, Oct. 6, 1992, abandoned, which is a continuation-in-part of Ser. No. 741,648, Aug. 7, 1991, abandoned.

[51] Int. Cl.[6] ..... A63H 3/28; A63H 13/00

[52] U.S. Cl. ..... 446/299; 446/303; 446/354; 446/486

[58] Field of Search ..... 446/297, 298, 446/299, 300, 302, 303, 332, 334, 335, 352, 353, 354, 369, 370, 371, 379, 380, 390, 484, 486

[56] References Cited

U.S. PATENT DOCUMENTS

| | | | |
|---|---|---|---|
| 3,287,020 | 11/1966 | Beebe . | |
| 3,548,594 | 12/1970 | Ceppi | 446/354 X |
| 3,650,065 | 3/1972 | Johmann | 446/354 |
| 3,672,096 | 6/1972 | Johmann | 446/34[5]4 X |
| 3,684,291 | 8/1972 | Johmann | 446/354 X |
| 3,792,490 | 2/1974 | Wigal . | |
| 3,895,451 | 7/1975 | Smrcka | 446/390 X |
| 3,904,210 | 9/1975 | Licitis . | |
| 4,017,905 | 4/1977 | Convertine et al. . | |
| 4,282,676 | 8/1981 | Davis . | |
| 4,516,951 | 5/1985 | Saigo et al. | 446/371 X |
| 4,775,352 | 10/1988 | Curran et al. | 446/299 X |
| 4,820,236 | 4/1989 | Berliner et al. | 446/484 X |
| 4,878,871 | 11/1989 | Noto | 446/297 X |
| 5,108,341 | 4/1992 | DeSmet | 446/299 |
| 5,157,316 | 10/1992 | Glovier | 446/299 X |
| 5,201,683 | 4/1993 | Ferri | 446/299 |

FOREIGN PATENT DOCUMENTS

| | | | |
|---|---|---|---|
| 2591501 | 6/1987 | France | 446/302 |
| 352221 | 3/1961 | Switzerland | 446/303 |
| 382475 | 10/1932 | United Kingdom | 446/330 |
| 549375 | 12/1958 | United Kingdom | 446/332 |

*Primary Examiner*—Robert A. Hafer
*Assistant Examiner*—D. Neal Muir
*Attorney, Agent, or Firm*—Duane, Morris & Heckscher

[57] ABSTRACT

This invention provides a doll having a head, a body, a motorized appendage for providing a caress, and a recorder for recording a personal, audible message to be played back. The doll further includes disengagement means for disengaging said motor upon the incidence of a threshold force level.

17 Claims, 6 Drawing Sheets

DOLL INCLUDING RECORDED MESSAGE MEANS

CROSS REFERENCE TO RELATED APPLICATION

This application is a Continuation application of U.S. application Ser. No. 07/957,242, filed Oct. 6, 1992, now abandoned, which in turn is a Continuation-in-Part application of commonly-owned U.S. Application Ser. No. 741, 648, filed on Aug. 7, 1991, now abandoned.

FIELD OF THE INVENTION

This invention relates to toy recorders adapted for receiving a personal message, and especially, toy recorders located within dolls.

BACKGROUND OF THE INVENTION

Talking dolls have long been desirable products for toy manufacturers since they are not only attractive but provide a dialogue for entertaining children. Such dolls are often equipped with sound reproducing devices including a small record and needle assembly powered by a battery or spring. See Beebe, U.S. Pat. No. 3,287,020, Davis, U.S. Pat. No. 4,282,676, and Licitis, U.S. Pat. No. 3,904,210, which are hereby incorporated by reference. While prerecorded messages on tiny records provide reliable artificial speech, there is no personalization of the voice or recorded message.

Other manufacturers have incorporated miniature tape recorders for permitting a voice interaction between the child and the toy whereby a child can speak to the toy and thereafter play back a recorded message. Such mechanisms, like the tiny record players before them, employ battery or spring-activated driving means. See Convertine et al., U.S. Pat. No. 4,017,905 and Wigal, U.S. Pat. No. 3,792,490, which are hereby incorporated by reference.

While these earlier toy designs have been implemented in certain commercial dolls, there remains a need for a doll which is more life-like. Accordingly, there is a need for a doll having a recorded message means which is adapted for receiving a personal message from a parent or a loved one and which optionally includes means for caressing the child as this message is played back. Such a product would help to alleviate some of the loneliness experienced by child left in day-care facilities or other temporary situations away from loved ones.

SUMMARY OF THE INVENTION

This invention provides dolls, including recorded message devices, for entertaining children. The dolls include a body portion and a head portion and at least one moveable appendage. They further include a recording device disposed within the doll for recording a personal, audible message to be played back. The head, body, or appendage is motorized to provide a caress of the doll upon playback of the recorded message. This motion is discontinued upon the exertion of a force upon the appendage which is greater than about one pound, for example, when the appendage abuts a child's face perpendicularly, or the like.

In further aspects of this invention, a moveable appendage including a soft, synthetic, flesh-like material can be made to move in a caressing motion during the playback of the recorded message. The combination of a parent's voice along with a caressing flesh-like hand is believed to be far more soothing to a child than just a synthetic voice playback alone. Further improvements included in this invention are the use of modern microcassette devices and various disengagement designs for halting the caressing action of the described dolls, toys, and stuffed animals.

BRIEF DESCRIPTION OF THE DRAWINGS

The accompanying drawings illustrate preferred embodiments of the invention as well as other information pertinent to the disclosure, and in which.

DETAILED DESCRIPTION OF THE INVENTION

Figure 1:
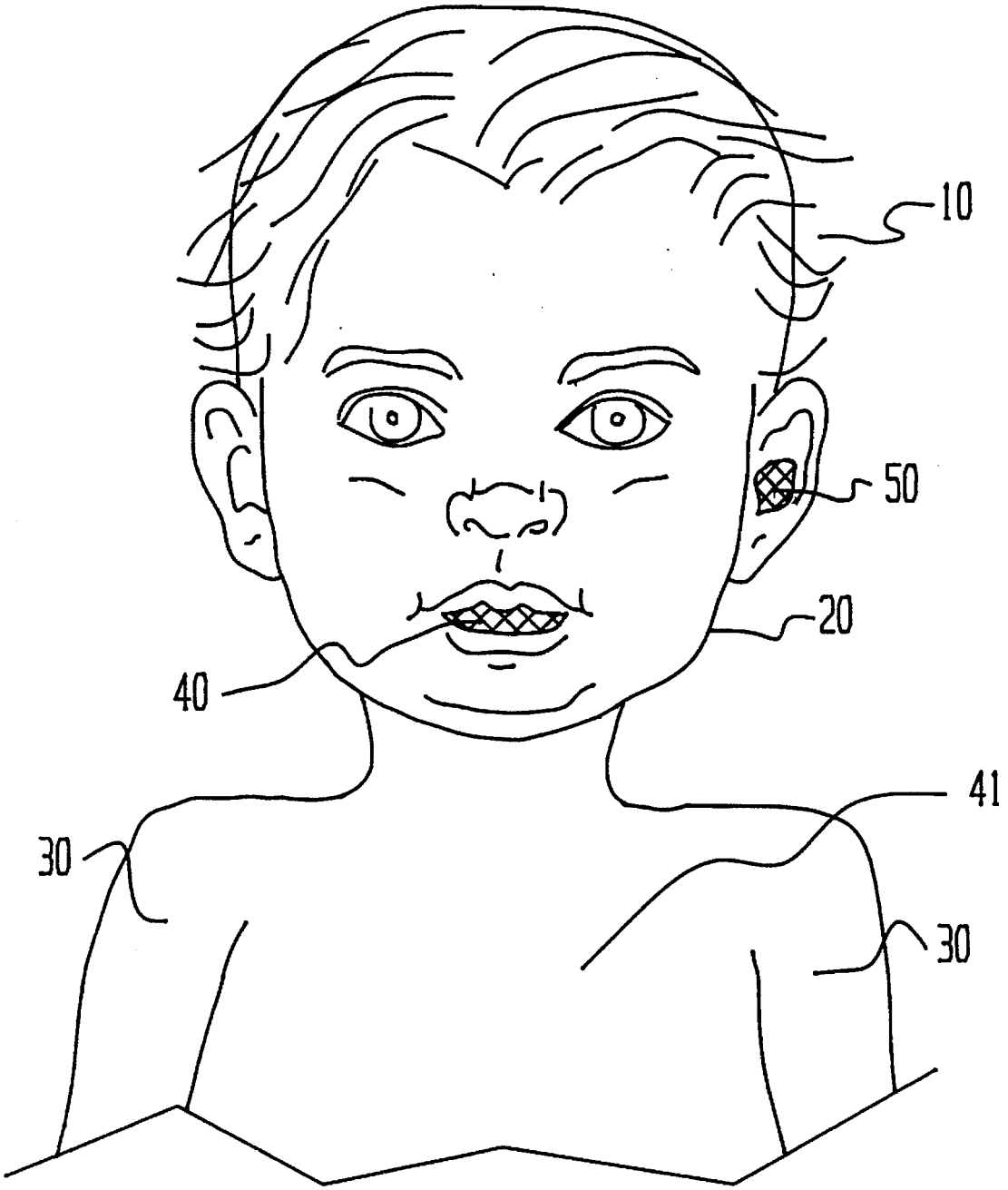
FIG. 1: is a front plan view of a preferred doll of this invention.

With reference to FIG. 1, there is shown a toy doll 10 having a child-like appearance including a head portion 20, body portion 41, and a pair of appendages, such as arms 30. It is understood that the doll of this invention could have features other than those which are "child-like", such as those associated with adults, animals, or purely fictional creatures. In the preferred embodiment described, the miniature microphone 50 is located in the ear of the doll and a small speaker 40 is located in the mouth region.

Figure 2:
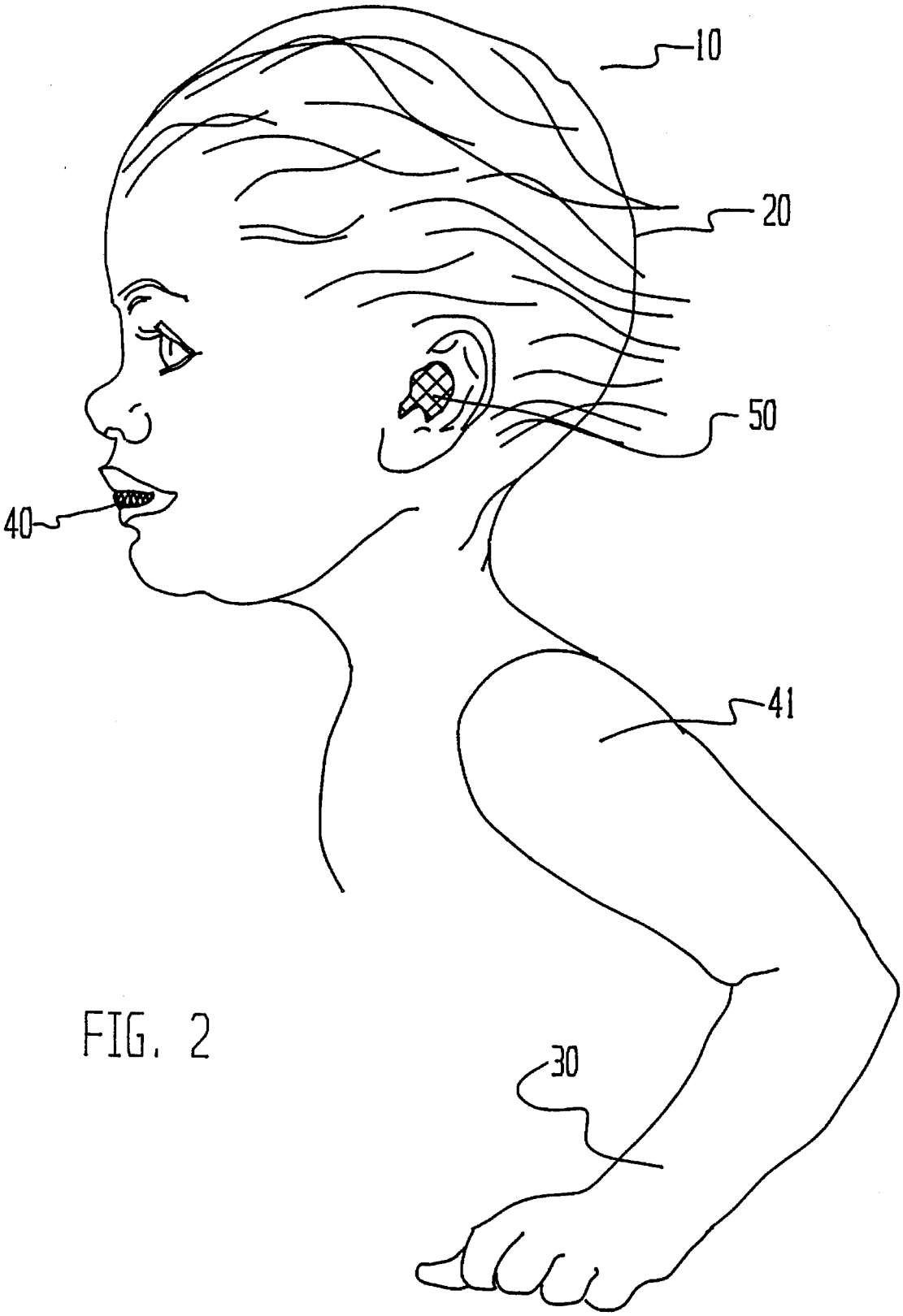
FIG. 2: is a side plan view of the doll of FIG. 1.

FIG. 2 illustrates the preferred toy doll 10 from a side elevation view, and more clearly illustrates the small speaker 40. Preferably, a protective metallic or plastic screen element covers the opening of the mouth and ear so as to protect the speaker 40 and microphone 50 from puncture or damage by objects that a child may introduce into these apertures.

Figure 3:
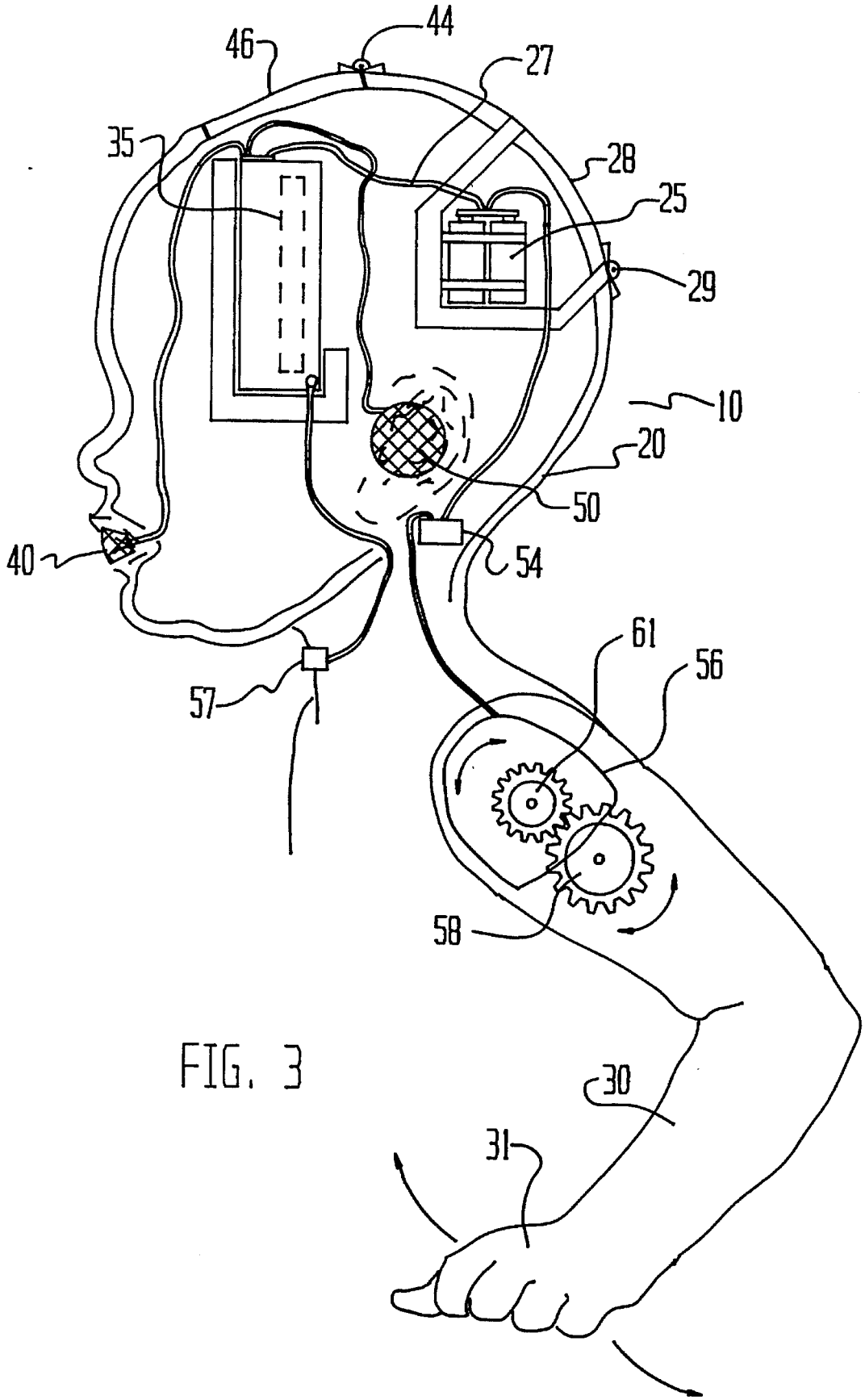
FIG. 3: is a side cross-sectional view of the doll of FIG. 2, illustrating preferred recorder circuitry.

With reference to FIG. 3, there is shown in cross-sectional schematic view the operational hardware for effecting the vocal and caressing activities of the toy doll 10 of this invention. As described in FIG. 3, the preferred head portion 20 includes hinged doors 46 and 28 including hinges 44 and 29 for permitting access to a battery compartment and a recorder compartment. Preferably, the hinged doors 46 and 28 are provided above the hairline of the toy doll 10.

The recorder 35 of this invention preferably is a remarkable battery-operated device having an automatic rewind feature which permits repeated operation of the recorder 35 upon activation of switch 57. During use, a child merely presses switch 57 which causes the prerecorded personal message to be played through the small speaker 40. Alternatively, the prerecorded personal message can be played through ear phones inserted into a ear phone jack mounted on the recorder or through the doll's skin, for better access by a child. A volume control adjustment could also be provided at similar locations.

Miniature microphone 50 is employed for recording personal messages. Recorder 35 can either be voice-activated or include a switch for activating the microphone 50. The switch can be located on the recorder 35 and be accessed by opening door 46, or an external switch 57 can be provided on the surface of the doll. If voice activation is employed, a switch can be provided for deactivating the voice activation mechanism after the message is recorded. The recorder 35 may include the typical features normally associated with microcassette recorders, such as hinged tape compartments for permitting the user to exchange tapes, automatic rewind, and reverse features, etc. Electronic recorders employing voice-activation, automatic rewind apparatus, and microelectronic circuitry are well within the scope of the art as evidenced by U.S. Pat. Nos. 5,012,820; 5,008,835; 4,982,305; 4,654,485; 4,436,959; 4,421,954; 4,147,898; and 3,764,089, which are hereby incorporated by reference.

The toy doll 10 of this invention can also include a mechanical, spring-activated tape recorder system, such as those described in U.S. Pat. No. 3,792,490 and 4,017,905. For example, this invention can include a spring-driven apparatus which can be made to take and repeat brief messages merely by pulling and releasing a winding cord. Such devices typically include a magnetic tape disposed between a take-up reel and a supply reel. A wind up spring is anchored at one end to the doll body and the other end to the take up reel for urging the take up reel in a rotational direction. The loaded spring winds portions of the tape onto the take up reel and unwinds portions from the supply reel. A pull string is usually provided which is attached to a portion of the supply reel for manually urging a rotation. A child grasps a ring attached to the pull string and applies a pulling force which winds portions of the tape onto the supply reel and unwinds portions of the tape from the tape up reel against the force of the spring and with the tape moving in a reverse direction, thus loading the spring. The operator then releases the ring, enabling the spring to rewind portions of the tape onto the take up reel and unwind portions of the tape from the supply reel with the tape moving in a forward direction. Recording sounds onto the magnetic tape can be made in unison with microphone 50.

In another important aspect of this invention, mechanical means are provided for actuating one of the doll's appendages in a simulated caressing motion. In a preferred mechanism describing FIG. 3, an electric motor 56 is connected in series with the D.C. flip-flop circuit 54 and the battery source 25. The polarity of the voltage leading into the motor 56 is varied by the flip-flop circuit 54 so as to cause a reciprocating movement of the small gear 61 of the motor 56. In turn, the large gear 58 connected to the appendage 30 of the doll 10 is caused to rotate alternately in two directions so as to permit a caressing motion of the hand 31 against a child's face, for example. In addition to shoulder activation, driving mechanisms can be provided in the wrist or elbow, or even in the legs of the doll. It is understood that mechanical motion means, such as that described in U.S. Pat. No. 4,282,676, hereby incorporated by reference, could equally be retrofitted within the doll to accommodate a caressing motion of the appendage 30.

Additionally, a mechanical switching mechanism could be employed instead of electronic flip-flop for providing an alternating polarity for electric motor 56. It is further understood that those of ordinary skill would be capable of employing a mechanical spring mechanism in place of electric motor 56, such mechanical spring mechanisms are described in U.S. Pat. No. 4,282,676, and do not require battery operation.

Figure 4:
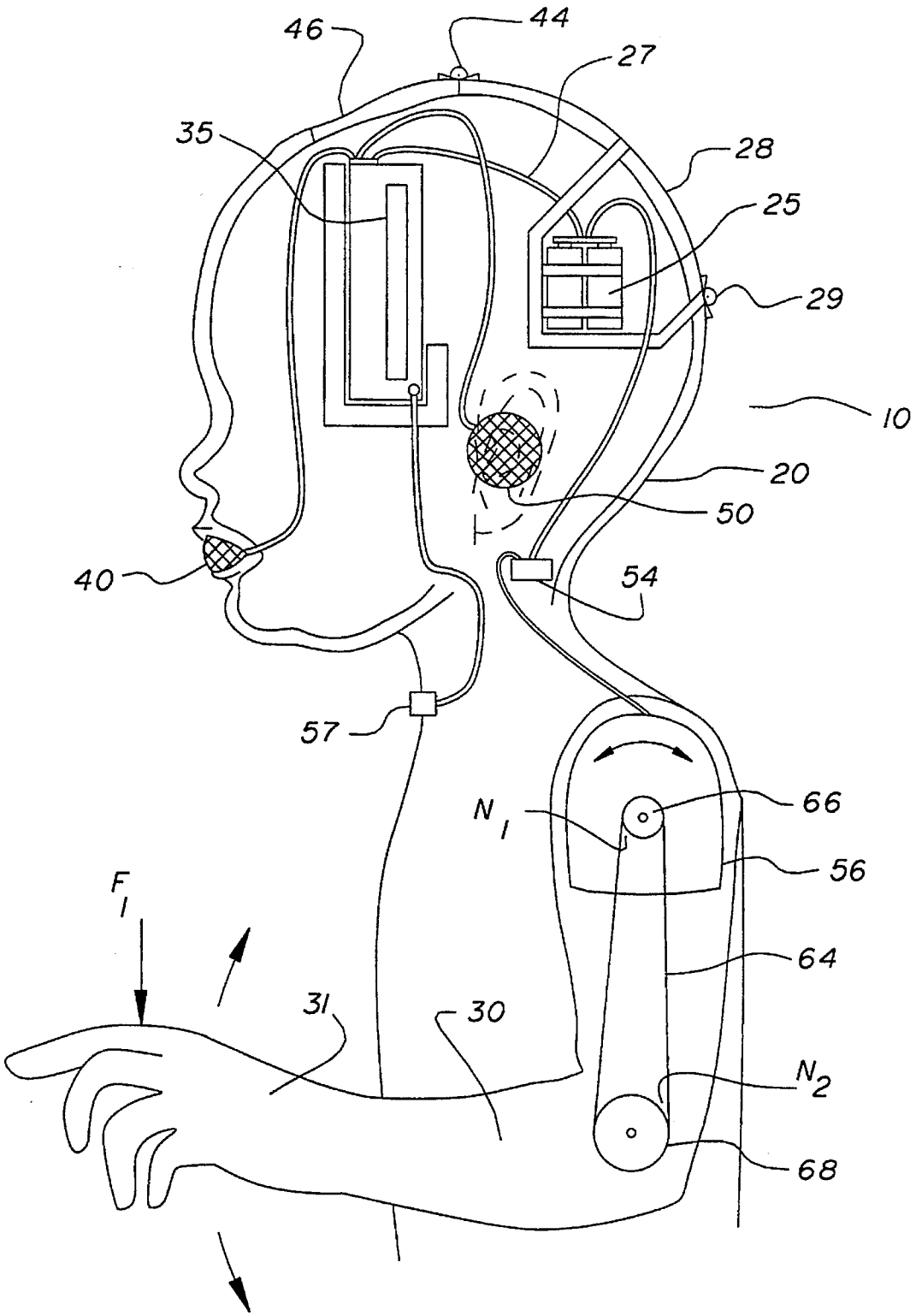
FIG. 4: is a side cross-sectional view of an alternative preferred doll, illustrating a disengagement means using a belt and two pulleys.
Figure 5:
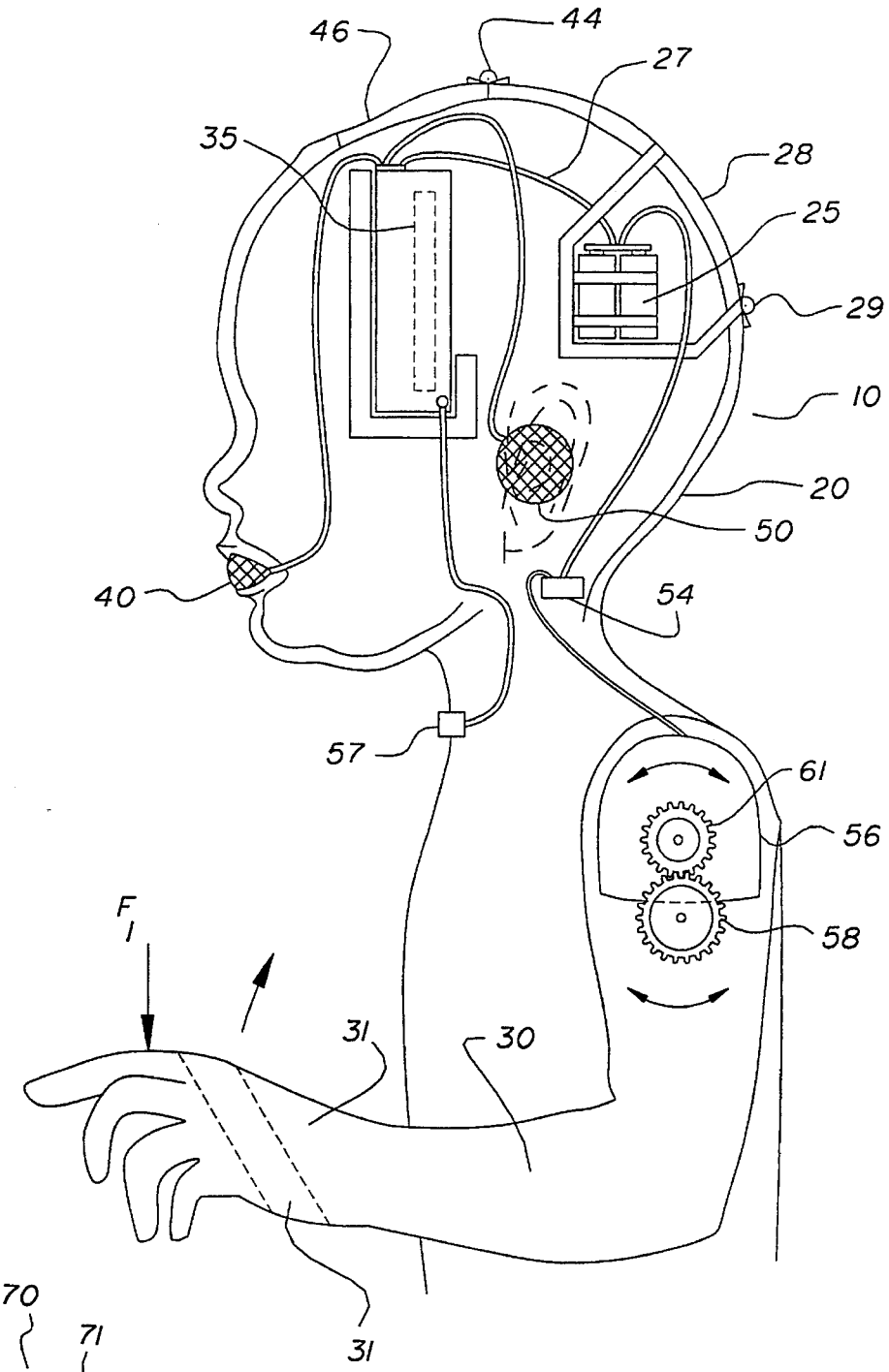
FIG. 5: is a side cross-sectional view of an alternative preferred doll, illustrating a preferred disengagement means using a pressure sensitive switch.
Figure 6:
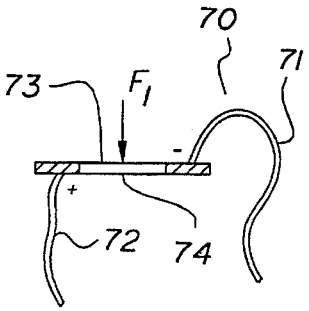
FIG. 6: is a side cross-sectional view of the preferred pressure sensitive switch of FIG. 5.
Figure 7:
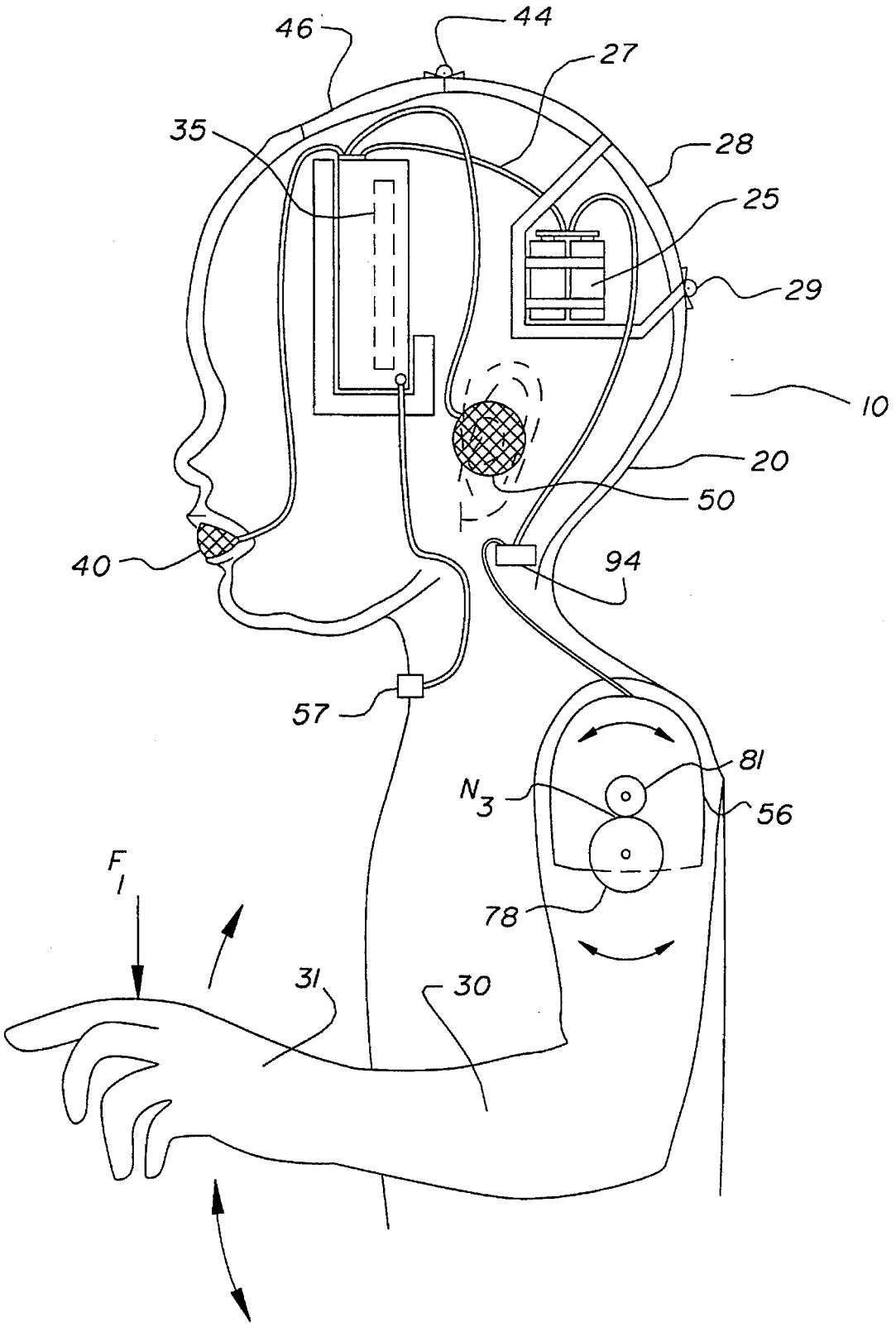
FIG. 7: is a side cross-sectional view of an alternative preferred doll, illustrating a preferred disengagement means using a pair of driving wheels.

In further embodiments of this invention described in FIGS. 4, 5, and 7, the motor 56 is equipped with a disengagement device for discontinuing the activation of the motor 56 upon the exertion of a force $F_1$ greater than about one pound upon the appendage 30. The dolls of this invention are designed to provide a soft, caressing motion. Accordingly, if a force greater than $F_1$ is applied to the appendage, for example, if the hand 31 of the doll comes into abrupt contact with the chin or ear of a child, the disengagement means of this invention will either cut off the power to the motor 56 or permit the motor to continue to rotate but discontinue the motion of the appendage. It is understood that the force $F_1$ can be the result of the child contacting the appendage, or the appendage contacting the child, or a combination of both. The caressing motion is also preferably a slow, repetitive motion, for example, the full cycle of the motion should consume at least about ½ second, preferably in excess of about three seconds or five seconds. As used herein, a full cycle is a full circle or back-and-forth motion of the head or appendage.

In a first embodiment of the disengagement means of this invention shown in FIG. 4, a pair of pulley wheels 66 and 68 are provided with a belt 64. Upon rotation of the motor 56, the first pulley 66 will preferably rotate alternatively in at least two directions, thereby generating a corresponding motion of pulley 68 through the belt 64. Upon receiving a force $F_1$ of greater than about one pound, the belt 64 is designed to slip. In other words, the relative frictional force $N_1$ between the pulley and the belt 64, and/or the frictional force $N_2$ between the pulley 68 and the belt 64 is overcome by the force $F_1$ sufficiently to cause the belt to slip.

Similarly in FIG. 7, the motor 56 can be equipped with cams or driving wheels 78 and 81 which have a frictional force $N_3$ therebetween. When a force $F_1$ exceeding one pound is applied to the appendage 30, the frictional driving force between the driving wheels 78 and 81 is overcome, and wheel 81 rotates without moving wheel 78. Preferably, one of the wheels 78 or 81 is made of a resilient polymer or rubber, and the other is a relatively non-resilient polymer or metal, so that one of the wheels will yield when the force $F_1$ is applied. An adjustment screw (not shown) can be provided to compress the wheels together, if there is wear of the softer wheel during long term use. In such a case, either one of the wheels 81 or 78 or motor 56 can be equipped for sliding within a slot, or the like, to accommodate biasing.

In still a further approach to providing disengagement of the motor 56 shown in FIG. 5, a pressure-sensitive switch 70 can be provided on the appendage 30, and preferably in the palm of hand 31 of the appendage. The switch 70 is preferably electrically connected to battery 25 in the flip-flop circuit 54. Upon contacting a force $F_1$ of greater than about one pound, the thin metallic foils 73 and 74 contact to establish a conductive flow of current between the positive and negative contact wires 71 and 72 leading to and from the flip-flop circuit 54. The flip-flop circuit 54 of this design is especially equipped with a relay for opening the circuit between the battery 25 and the motor 56 upon activation of the microswitch 70. In use, the caressing motion is activated upon playback of the recorded message, and is disengaged upon the occurrence of a force $F_1$ greater than about one pound on the microswitch 70. The doll can then be reactivated by engaging switch 57.

Both the yieldable torque members described by the belt and pulley configurations of FIGS. 4 and 7, and the microswitch configuration of FIG. 5 are designed to substantially eliminate injury to children during the use of the doll of this invention. Likewise, a spring-wound driving mechanism can be employed in these dolls for providing motion. Such coils preferably can be halted from unwinding by a force greater than about one pound. The reciprocating motion of the appendage is therefore limited to a gentle, caressing motion, since a resistance of one pound or more will create a force incident upon the appendage 30 sufficient to deactivate the motion, at least temporarily until the force is removed.

In still a further embodiment of this invention (not shown), an actuation rod having a bent axis can be engaged by the motor 56 to provide a slow circular rotation along the exposed end of the rod. This rod can be inserted in the head or appendage of the doll to provide a slow cyclical caressing motion. As disclosed above, a suitable yieldable torque member or spring can be provided to prevent injury and to limit the force of the motion to a soft caress.

From the foregoing, it can be realized that this invention provides toy dolls capable of receiving a personal recorded message for later playback by a child, for example, while attending a day-care facility. The doll is specially equipped with life-like features and includes speaker means located in the mouth and microphone receiving means located in the ear, for creating a more realistic image. The palm and/or face portion of the doll can include soft, flesh-like polymeric materials for further comforting the child during use. Although various equipment embodiments have been illustrated, this was for the purpose of describing and not limiting this invention. Various modifications, which will become apparent to one skilled in the art, are within the scope of this invention as set forth in the attached claims.

What is claimed is:

1. A soft, flexible doll comprising: a head, body, motor, battery and at least one appendage thereon;

recording means inserted within said doll for recording and playing a personal audible message to be audibly played back;

said motor disposed within said doll for activating said appendage to move in a cyclical oscillating motion, said doll comprising disengagement means for discontinuing said oscillating motion upon encountering a resistance that would otherwise cause said motor to generate a force that may injure a child; and means for simultaneously activating said motor and, thereby, said appendage, upon activation of said recording means for playback of said personal audible message.

2. The doll of claim 1, wherein said recording means comprises a microcassette tape recorder located within a readily accessible compartment within said doll.

3. The doll of claim 2, wherein said caressing motion comprises a cycled motion of at least about one second in duration.

4. The doll of claim 1, wherein said appendage is activated by said motorized means and comprises a soft, synthetic, flesh-like material.

5. The doll of claim 1, wherein said appendage is activated to simulate a circular caressing motion.

6. The doll of claim 5, wherein said recording means and said motorized appendage are powered by a battery.

7. The doll of claim 5, wherein said appendage comprises an arm or hand of said doll.

8. The doll of claim 1, wherein said motorized means comprises an electric motor.

9. The doll of claim 8, wherein said disengagement means comprises yieldable torque member.

10. The doll of claim 8, wherein said disengagement means comprises a pressure sensitive switch.

11. A soft, flexible doll comprising: a body portion, a head portion, a motor, battery, and a pair of arms wherein a first of said arms is connected to said motor to produce a cyclical reciprocating motion, said first arm comprising a soft, synthetic, flesh-like fabric disposed thereon to safely contact human flesh during use;

micro-recording means disposed within said doll for recording a personal audible message to be played back;

disengagement means for arresting the motion of said first arm in response to a resistance that would otherwise cause said motor to generate a force that may injure a child, such that said arm motion is stopped when said arm is in an unsafe abutting contact with said child; and means for simultaneously activating said motor and, thereby, said appendage, upon activation of said recording means for playback of said personal audible message.

12. The doll of claim 11, wherein said caressing motion comprises at least a cycled motion of at least ½ second in duration.

13. The doll of claim 11, wherein said motor is powered by a battery.

14. The doll of claim 11, wherein said disengagement means comprise a yieldable torque member.

15. The doll of claim 14, wherein said yieldable torque member comprises a belt.

16. The doll of claim 14, wherein said yieldable torque member comprises a resilient wheel contact.

17. A method for recording a personal message within a doll for playback, comprising:

providing a soft, flexible doll, comprising: a head portion, a body portion, at least one motor with at least one battery coupled thereto within said body portion and at least one appendage linked to and powered by said motor to move in a cyclical reciprocating motion, a recorder mechanism enclosed within said doll, switch means connected to said recorder mechanism and said motor for simultaneously activating said motor and recorder mechanism, and disengagement means connected to said motor for arresting said reciprocating motion of said appendage upon the encountering of a resistance which would otherwise cause said motor to generate an application of a potentially harmful force, such as when said appendage moves as if to harmfully strike or impact a child or when said appendage is restrained from freely moving;

the method further comprising:

recording a personal, audible message on said recorder mechanism for later playback; and activating said switch means to move said appendage in a cyclical reciprocating motion simultaneously with the playback of said personal message whereby said cyclical motion resembles a series of caresses.

* * * * *